US005896929A

United States Patent [19]

Dori

[11] Patent Number: 5,896,929

[45] Date of Patent: Apr. 27, 1999

[54] METHOD AND APPARATUS FOR DISPLAYING INFORMATION ALONG COMPLIANT GROUND

[76] Inventor: Patrick Dori, 8 Hedgerow Dr., Englewood, N.J. 07631

[21] Appl. No.: 08/151,944

[22] Filed: Nov. 15, 1993

[51] Int. Cl.[6] ..... A43B 23/00

[52] U.S. Cl. ..... 172/1

[58] Field of Search ..... 172/1, 49.5, 68, 172/70, 540; 404/72, 92, 93, 124, 103, 122, 128; 427/264, 270, 373, 375; 428/172, 913, 914

[56] References Cited

U.S. PATENT DOCUMENTS

| | | | |
|---|---|---|---|
| D. 51,917 | 4/1918 | Bruess . | |
| 307,015 | 10/1884 | Chapuis | 111/142 X |
| 1,895,045 | 1/1933 | Moore | 404/93 X |
| 2,830,511 | 4/1958 | Wills et al. . | |
| 3,515,220 | 6/1970 | Reece | 172/123 X |
| 3,832,079 | 8/1974 | Moorhead . | |
| 3,910,737 | 10/1975 | Chandler et al. . | |
| 3,970,012 | 7/1976 | Jones, Sr. | 172/540 X |
| 4,050,167 | 9/1977 | Senter . | |
| 4,050,168 | 9/1977 | Pace . | |
| 4,056,328 | 11/1977 | Maxey . | |
| 4,105,354 | 8/1978 | Bowman | 172/540 X |
| 4,151,883 | 5/1979 | van der Lely et al. | 172/123 X |
| 4,958,446 | 9/1990 | Brown | 36/11.5 |
| 5,088,855 | 2/1992 | Giliberti | 404/103 |
| 5,224,552 | 7/1993 | Lee et al. | 172/123 X |

OTHER PUBLICATIONS

Summerize Your Promotional Objectives, 1993–1994 Planner Workbook, p. 58.

*Primary Examiner*—Thomas B. Will
*Assistant Examiner*—Robert Pezzuto
*Attorney, Agent, or Firm*—Arthur Jacob

[57] ABSTRACT

Method and apparatus for displaying information along an extended area of compliant ground, such as along a sandy beach, the method and apparatus temporarily displaying a series of repetitive messages upon the extended area by impressing the messages into the compliant ground at regularly spaced intervals along the extended area.

11 Claims, 3 Drawing Sheets

METHOD AND APPARATUS FOR DISPLAYING INFORMATION ALONG COMPLIANT GROUND

The present invention relates generally to the display and dissemination of information and pertains, more specifically, to method and apparatus for creating temporary messages over an extended area of compliant ground, such as along beaches and the like, for view during a limited period.

The dissemination of information over extended areas through the use of visual displays capable of being viewed over a wide field of view is quite well known. For example, advertising and public service announcements commonly are disseminated at resort areas and at various sporting events by visual messages displayed for wide view, such as on airships and aircraft, and by skywriting, as well as by the placement of a myriad of signs throughout the various areas. Some of these practices are considered by many to be obtrusive and quite unattractive, as well as wasteful of resources and harmful to the ecology, and especially the ecology associated with bathing beaches, which have become a favorite site for such activities.

The present invention provides method and apparatus for creating temporary displays for the dissemination of information over extended areas, such as the temporary placement of messages along a beach for purposes of advertising or public service announcements. As such, the present invention attains several objects and advantages, some of which are summarized as follows: Enables the dissemination of information, such as advertising messages and public service announcements, along extended areas, such as bathing beaches, unobtrusively and without permanent defacement of the extended area; creates a series of repetitive visual displays of information along an extended area of compliant ground, such as along a sandy bathing beach, a snow-covered ski slope, and the like, without permanently affecting the extended area over which the information is disseminated; enables the use of generally available equipment, with only minimal additional apparatus, for impressing messages over an extended area of compliant ground to convey advertising and public service information; promotes conservation and protects against the defacement of resort and recreation areas; conveys information, such as advertising and public service messages, over a wide area without additional clutter and without permanent alteration of the area.

The above objects and advantages, as well as further objects and advantages, are attained by the present invention, which may be described briefly as the method of and apparatus for displaying information along an extended area of compliant ground, such as along a sandy beach, the method and apparatus comprising: the step of and means for temporarily displaying a series of repetitive messages upon the extended area by impressing the messages into the compliant ground at regularly spaced intervals along the extended area.

The invention will be understood more fully, while still further objects and advantages will become apparent, in the following detailed description of preferred embodiments of the invention illustrated in the accompanying drawing, in which.

Figure 1:
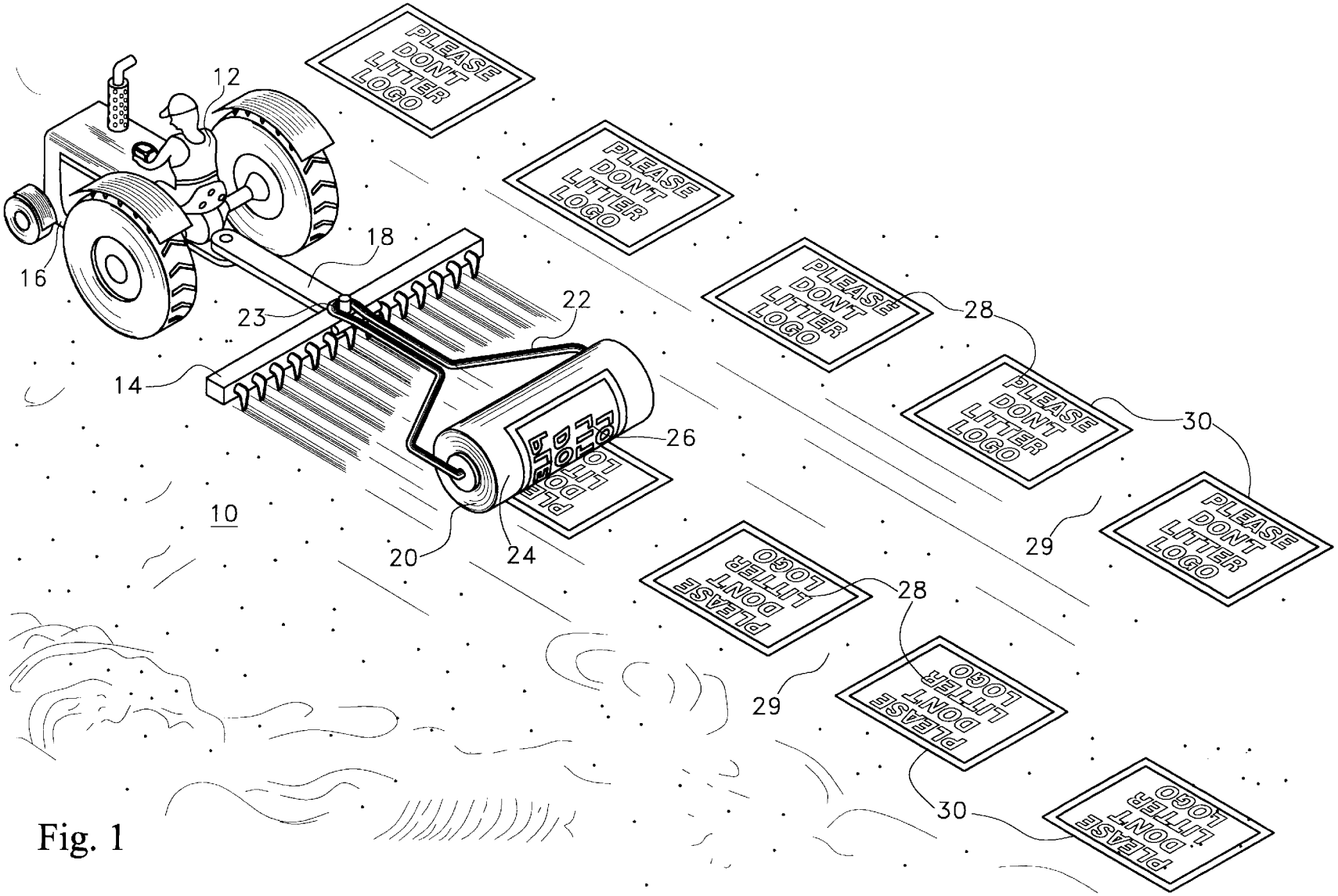
FIG. 1 is a pictorial perspective view of an apparatus constructed in accordance with the invention and illustrates a method of the invention.
Figure 2:
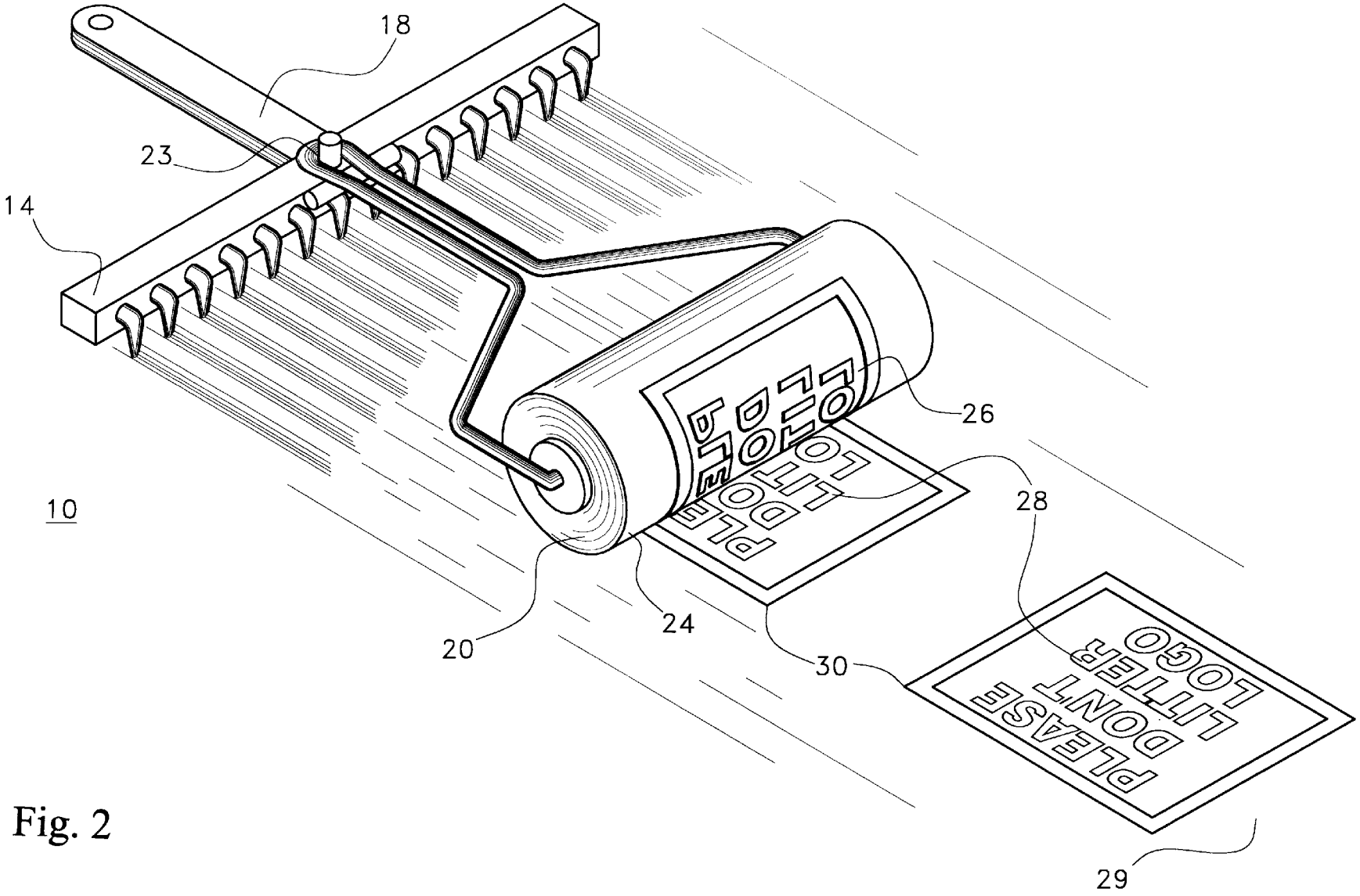
FIG. 2 is an enlarged fragmentary view of a portion of FIG. 1.

Referring now to the drawing, and especially to FIGS. 1 and 2 thereof, an extended area of relatively soft, compliant ground is illustrated in the form of a bathing beach 10, where the compliant ground is constituted primarily of sand. Bathing beach 10 provides a recreational or resort facility for the public and, as such, is visited daily by large numbers of people. During the season of such daily visits, a grounds keeper 12 combs the beach 10 each morning with a rake 14 coupled to a tractor 16 by means of a draw bar 18 so as to be drawn by the tractor 16 over the beach 10 to maintain the beach 10 clean and orderly for the day's use. Usually, such beaches have various signs posted along the beach advising the users of the beach of rules and regulations and admonishing users to make an effort to keep the beach clean and generally free of litter. However, such posted signs are found by many to be unsightly and to detract from the natural beauty of the beach. Moreover, the signs are subjected to weather and other wear and tear and do not exhibit a long service life. In addition, vandalism and graffiti often take their toll of such signs.

The present invention replaces conventional signs with messages impressed directly in the sand. Thus, an apparatus constructed in accordance with the invention includes a roller 20 journaled on a frame 22 coupled at 23 to the draw bar 18 for following the rake 14. Roller 20 has an outer cylindrical surface 24 which carries a latent message 26, in relief. Upon drawing the roller 20 along the beach 10, behind the rake 14, the latent message 26 is impressed in the compliant sand of beach 10, and is repeated in a series of repetitive visual messages 28 placed in regular spaced intervals along the path 29 traveled by the tractor 16. Impressing of the latent message 26 to establish a visual message 28 in the compliant sand of the beach 10 is facilitated by smoothing the sand somewhat, immediately ahead of roller 20, preferably with the rake 14, so as to enable the roller 20 to traverse a relatively smooth surface along the path 29. As the roller 20 rotates, the series of repetitive visual messages 28 is laid down by rolling contact between the surface 24 of the roller 20 and the sand of the beach 10 along the path 29.

In the illustrated example, the visual messages 28 are in the form of a series of repetitive signs 30 admonishing users of the beach 10 to refrain from littering the beach 10. In addition, each visual message 28 includes a logo, or the like, for identifying an advertiser who sponsors the program promoted by the text of the visual message 28. The signs 30 are spread over the beach 10 so as to be viewed by users of the beach 10, all along the beach 10. The signs 30 are temporary in that the signs 30 are obliterated during the day by the traffic on the beach 10; however, enough signs 30 are present so that the visual message 28 is seen by users before all of the signs 30 are obliterated. Since the beach 10 normally is raked daily, the signs 30 are replaced daily, without excessive added effort, and are made available for each day's visitors.

Figure 5:
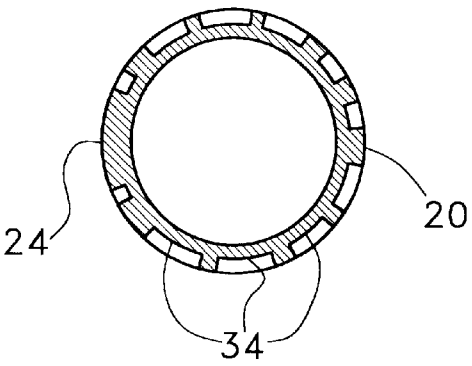
FIG. 5 is a cross-sectional view similar to FIG. 4, but illustrating another embodiment of the invention.
Figure 4:
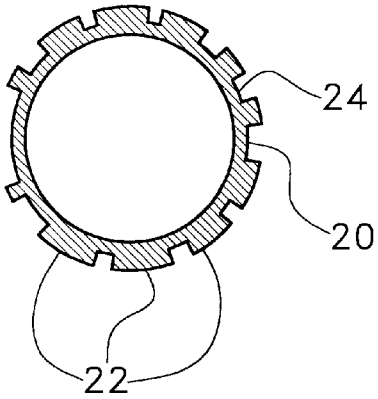
FIG. 4 is a cross-sectional view taken along line 4—4 of FIG. 3.
Figure 3:
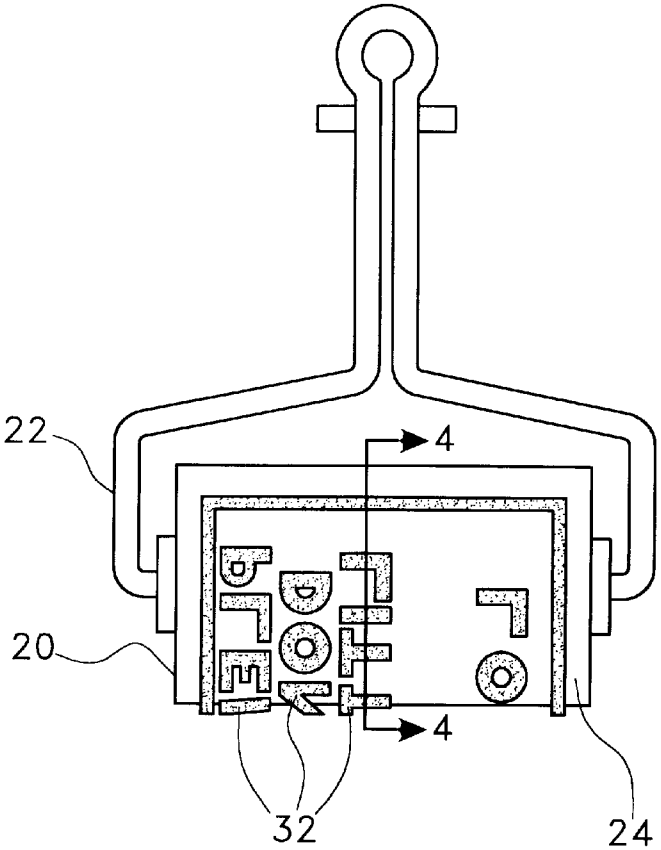
FIG. 3 is a top plan view of a portion of the apparatus.

Turning now to FIGS. 3 and 4, latent message 26 is seen to include graphic elements in the form of raised characters 32 along the outer cylindrical surface 24 of the roller 20. In this manner, the visual messages 28 of signs 30 are embossed in the sand of the beach 10. In the alternate embodiment shown in FIG. 5, the latent message 26 is seen to include graphic elements in the form of recessed characters 34 along the cylindrical surface 24 of the roller 20 and the visual messages 28 of signs 30 are debossed in the sand of the beach 10. In either instance, the signs 30 are laid down in a repetitive series of visual messages 28 at regularly spaced intervals along the beach 10 for presenting the information in sign 30 for view over a very wide area. The signs 30 are temporary and represent no harm to the ecology of the beach 10.

It will be appreciated that the method and apparatus of the invention is available for displaying visual messages 28 in compliant ground found at a variety of locations. Thus, in addition to providing visual messages 28 along beaches 10, as described above, visual messages 28 may be impressed in snow at ski slopes and along other areas at winter resorts. Various race tracks, such as horse racing tracks and automobile dirt tracks, which ordinarily are raked between races, may be impressed with a series of visual messages 28, as described herein.

It will be seen that the present invention attains all of the objects and advantages summarized above, namely: Enables the dissemination of information, such as advertising messages and public service announcements, along extended areas, such as bathing beaches, unobtrusively and without permanent defacement of the extended area; creates a series of repetitive visual displays of information along an extended area of compliant ground, such as along a sandy bathing beach, a snow-covered ski slope, and the like, without permanently affecting the extended area over which the information is disseminated; enables the use of generally available equipment, with only minimal additional apparatus, for impressing messages over an extended area of compliant ground to convey advertising and public service information; promotes conservation and protects against the defacement of resort and recreation areas; conveys information, such as advertising and public service messages, over a wide area without additional clutter and without permanent alteration of the area.

It is to be understood that the above detailed description of preferred embodiments of the invention are provided by way of example only. Various details of procedure, design and construction may be modified without departing from the true spirit and scope of the present invention as set forth in the appended claims.

The embodiments of the invention in which an exclusive property or privilege is claimed are defined as follows:

1. A method of displaying information along an extended area of compliant ground, the method comprising:

temporarily displaying a series of repetitive messages upon the extended area by smoothing the compliant ground alone at least a portion of the extended area to establish a path of smoothed compliant ground along the extended area; and impressing the messages into the compliant ground at regularly spaced intervals along the path of smoothed compliant around by rolling an impressing means along the smoothed compliant ground immediately subsequent to smoothing the compliant ground along the portion of the extended area to attain rolling contact between the rolling impressing means and the compliant ground along the path of smoothed compliant ground, the rolling impressing means carrying at least one latent image of the message.

2. A method of displaying information along an extended area of compliant ground, the method comprising:

temporarily displaying a series of repetitive messages upon the extended area by smoothing the compliant around along at least a portion of the extended area to establish a path of smoothed compliant around along the extended area, the smoothing including raking the compliant around of the extended area along the portion thereof; and impressing the messages into the compliant around at regularly spaced intervals along the path of smoothed compliant around by rolling an impressing means along the smoothed compliant ground immediately subsequent to raking to attain rolling contact between the rolling impressing means and the compliant ground along the path of smoothed compliant ground, the rolling impressing means carrying at least one latent image of the message.

3. A method of displaying information along an extended area of compliant ground, the method comprising:

temporarily displaying a series of repetitive messages upon the extended area by smoothing the compliant around along at least a portion of the extended area to establish a path of smoothed compliant around along the extended area; and impressing the messages into the compliant ground at regularly spaced intervals along the path of smoothed compliant ground by embossing the compliant ground along the path of smoothed compliant ground immediately subsequent to smoothing the portion of the extended area.

4. A method of displaying information along an extended area of compliant ground, the method comprising:

temporarily displaying a series of repetitive messages upon the extended area by smoothing the compliant around along at least a portion of the extended area to establish a path of smoothed compliant around along the extended area; and impressing the messages into the compliant around at regularly spaced intervals along the path of smoothed compliant around by debossing the compliant ground along the path of smoothed compliant ground immediately subsequent to smoothing the portion of the extended area.

5. Apparatus for displaying information along an extended area of compliant ground, the apparatus comprising:

means for temporarily displaying a series of repetitive messages upon the extended area;

the means for temporarily displaying including impressing means carrying at least one latent image of the message for impressing the messages into the compliant around at regularly spaced intervals along the extended area; and means for smoothing the compliant ground along at least a portion of the extended area to establish a path of smoothed compliant ground along the extended area immediately ahead of the impressing means.

6. The apparatus of claim 5 wherein:

the means for temporarily displaying includes rolling impressing means; and the apparatus includes means for rolling the rolling impressing means along the compliant ground for impressing the messages into the compliant ground at fixed regularly spaced intervals along a path established along the compliant ground by rolling contact between the rolling impressing means and the compliant ground along the extended area.

7. The apparatus of claim 6 wherein the means for impressing the messages includes coupling means for coupling the impressing means to a vehicle for traversing the extended area.

8. The apparatus of claim 7 wherein the impressing means includes a roller having an outer surface for engaging the compliant ground, and graphic elements carried by the outer surface for impressing the messages in the compliant ground.

9. The apparatus of claim wherein the graphic elements are recessed within the outer surface and the messages are embossed in the compliant ground.

10. The apparatus of claim wherein the graphic elements are raised upon the outer surface and the messages are debossed on the compliant ground.

11. The apparatus of claim 5 wherein the means for smoothing includes a rake.

* * * * *

UNITED STATES PATENT AND TRADEMARK OFFICE

CERTIFICATE OF CORRECTION

PATENT NO. : 5,896,929

DATED : April 27, 1999

INVENTOR(S) : Patrick Dori

It is certified that error appears in the above-indentified patent and that said Letters Patent is hereby corrected as shown below:

Column 3, lines 54, 66 and 67, "around" should read --ground--;

Column 4, lines 2, 4, 6, 17, 18, 30, 31, 33, 35 and 47, "around" should read --ground--.

Signed and Sealed this

Sixteenth Day of November, 1999

*Attest:*

Q. TODD DICKINSON

*Attesting Officer*

*Acting Commissioner of Patents and Trademarks*